US008328147B2

(12) United States Patent
Gardner et al.

(10) Patent No.: US 8,328,147 B2
(45) Date of Patent: Dec. 11, 2012

(54) ARCHERY BOW MOUNTING BRACKETS AND INTEGRATED SUPPORT SYSTEMS

(76) Inventors: Kenneth R. Gardner, Phoenix, AZ (US); Jonathan L. Gardner, Glendale, AZ (US)

( * ) Notice: Subject to any disclaimer, the term of this patent is extended or adjusted under 35 U.S.C. 154(b) by 160 days.

(21) Appl. No.: 12/481,574

(22) Filed: Jun. 10, 2009

(65) Prior Publication Data

US 2010/0313864 A1 Dec. 16, 2010

(51) Int. Cl.
*F16M 11/00* (2006.01)

(52) U.S. Cl. ..... 248/176.1; 248/121; 248/156; 124/86; 124/88

(58) Field of Classification Search ..... 124/86, 124/89, 23.1, 88; 248/218.4, 121, 122.1, 248/176.1, 156
See application file for complete search history.

(56) References Cited

U.S. PATENT DOCUMENTS

| | | | | |
|---|---|---|---|---|
| 3,589,350 | A | 6/1971 | Hoyt, Jr. et al. | |
| 4,135,486 | A | 1/1979 | Enomoto | |
| 4,360,179 | A | 11/1982 | Roberts | |
| 4,491,123 | A | 1/1985 | Wirtz | |
| 4,570,608 | A | 2/1986 | Masterfield | |
| 4,907,567 | A | 3/1990 | Henrich | |
| 5,106,044 | A | 4/1992 | Regard, III et al. | |
| 5,205,272 | A | 4/1993 | Boyer | |
| 5,240,211 | A | 8/1993 | Anderson | |
| 5,273,022 | A | 12/1993 | Leven | |
| 5,383,441 | A | 1/1995 | Lightcap, Jr. | |
| 5,482,241 | A * | 1/1996 | Oglesby | 248/309.1 |
| 5,547,162 | A | 8/1996 | Sobolewski et al. | |
| 5,619,981 | A | 4/1997 | Breedlove | |
| 5,630,568 | A | 5/1997 | Lubrecht | |
| 5,645,215 | A * | 7/1997 | Marendt et al. | 232/17 |
| 6,070,569 | A | 6/2000 | Chalin et al. | |
| 6,663,059 | B1 * | 12/2003 | Warren | 248/156 |
| 6,749,170 | B1 | 6/2004 | Rhoads | |
| 6,817,352 | B1 | 11/2004 | Saunders | |
| 6,948,690 | B1 * | 9/2005 | Sandel | 248/218.4 |
| 6,957,648 | B1 | 10/2005 | Adcock | |
| 7,036,497 | B2 * | 5/2006 | Horn | 124/86 |
| 7,047,960 | B2 | 5/2006 | McCrea | |
| 7,314,199 | B1 | 1/2008 | Ward | |
| 7,347,402 | B2 | 3/2008 | White | |
| 7,434,773 | B1 | 10/2008 | Minjares | |
| 2002/0066446 | A1 * | 6/2002 | Kesti | 124/86 |
| 2003/0041850 | A1 | 3/2003 | Martin et al. | |
| 2005/0076896 | A1 | 4/2005 | McCrea et al. | |

OTHER PUBLICATIONS

PCT/US2010/038050 International Search Report dated Aug. 13, 2010.

* cited by examiner

*Primary Examiner* — Amy J Sterling
(74) *Attorney, Agent, or Firm* — Tod R. Nissle, P.C.

(57) ABSTRACT

The present invention relates generally to devices and methods for assisting archery bow hunters in making accurate shots while hunting in dynamic terrain. Generally, in accordance with various exemplary embodiments of the present invention, the present invention discloses various universal mounting brackets and integrated archery bow systems configured for coupling a support element to an archery bow. Most preferably, the universal mounting brackets and integrated archery bow systems are configured to give the bow hunter maximum stability and range of motion when aiming and/or firing the bow. In accordance with the various exemplary embodiments of the present invention, various universal mounting brackets and integrated archery bow systems configured for coupling a collapsible monopod support element to an archery bow is disclosed. Additionally, various universal mounting brackets configured for coupling an extendable bipod support element to an archery bow is disclosed.

3 Claims, 10 Drawing Sheets

ARCHERY BOW MOUNTING BRACKETS AND INTEGRATED SUPPORT SYSTEMS

FIELD OF INVENTION

The present invention relates generally to devices and methods for assisting archery bow hunters in making accurate shots while hunting in dynamic terrain. Generally, in accordance with various exemplary embodiments of the present invention, the present invention discloses various universal mounting brackets and integrated archery bow systems configured for coupling a support element to an archery bow. Most preferably, the universal mounting brackets and integrated archery bow systems are configured to give the bow hunter maximum stability and range of motion when aiming and/or firing the bow.

In accordance with the various exemplary embodiments of the present invention, various universal mounting brackets and integrated archery bow systems configured for coupling a collapsible monopod support element to an archery bow is disclosed. Additionally, various universal mounting brackets configured for coupling an extendable bipod support element to an archery bow is disclosed.

BACKGROUND OF THE INVENTION

Archery bow hunting has become increasingly popular. While hunting in dynamic terrain, archery bow hunters are required to perform numerous acts simultaneously to ensure accuracy of a shot. For example, archer must hold the bow one-handed at a full arm extension while drawing the bowstring with the opposing arm to the full extension of the bowstring. The archer must then attempt to hold the bowstring at full extension while aligning the sighting device with the target animal. The archer then releases the bowstring while attempting to keep the bow steady and level until the arrow leaves the arrow rest.

Many bow hunters, even the most experienced, find holding the archery bow steady, while taking a shot at an animal difficult. Given the amount of accessories available for archery bows, the bows themselves may weigh upwards of ten to fifteen pounds and may be unequally weighted. Thus, there has been a historic need for stabilization devices to balance and/or assist with control of the bow during shooting.

These stabilization devices typically include either weighting devices coupled to various parts of the bow assisting with the balancing of the bow's weight (See U.S. Pat. Nos. 3,589,350; 4,135,486; 4,491,123; 4,570,608; 4,907,567; 5,273,022; 6,817,352) or support elements coupled to an archery bow allowing for the archery bow to be rested on the ground while being shot (See U.S. Pat. Nos. 5,240,211; 7,047,960; 7,347,402; and United States Patent Publication 20050076896).

It is worthy of note that the above prior art, which allows stabilization of the archery bow during use is differentiated from prior art simply teaching an archery bow stand, which provides a place to set the archery bow while not in use. For examples of stationary archery bow stands not suitable for use during actual shooting of the archery bow, see U.S. Pat. Nos. 5,205,272; 5,547,162; 5,619,981; 6,957,648; 6,749,170; and 7,314,199. Additionally, the prior art teaches less useful devices and methods of stowing an archery bow like an attachment that provides for staking the bow into a tree (See U.S. Pat. No. 5,630,568).

As illustrated by the numerous stabilization devices and stands, an existing problem with designing an archery bow stabilization device is the multitude of archery bow configurations. Stated another way, because the configuration and architecture of archery bows vary based on archery bow manufacture and personal modification by the archery bow hunter, each stabilization device, stand, and/or support element often requires specialized mounts for attachment to different archery bows. Thus, there is a need for various universal mounting brackets and archery bow systems configured for coupling a support element to any archery bow that allow for maximum stability and range of motion during the aiming and/or shooting of any archery bow. The archer can then concentrate on shot placement and shooting form with the reduction of stress from the weight of the bow and arm fatigue.

SUMMARY OF THE INVENTION

The present invention relates generally to devices and methods for assisting archery bow hunters in making accurate shots while hunting in dynamic terrain. Generally, in accordance with various exemplary embodiments of the present invention, the present invention discloses various universal mounting brackets and integrated archery bow systems configured for coupling a support element to an archery bow. Most preferably, the universal mounting brackets and integrated archery bow systems are configured to give the bow hunter maximum stability and range of motion when aiming and/or firing the archery bow.

In accordance with the various exemplary embodiments of the present invention, various universal mounting bracket and/or integrated archery bow systems configured for coupling a collapsible/extendable monopod support element to an archery bow is disclosed. Additionally, various universal mounting brackets configured for coupling a collapsible/extendable bipod support element to an archery bow is disclosed.

Preferably, the present invention discloses a universal, front mounting bracket with monopod support element coupled to an archery bow. Most preferably, in accordance with the various exemplary embodiments of the present invention, the present invention discloses a universal, side mounting bracket with monopod support element coupled to an archery bow.

Further, in accordance with the various exemplary embodiments of the present invention, the present invention discloses a universal, front mounting bracket with bipod support element coupled to an archery bow allowing for rotation of the archery bow about the bipod support element.

BRIEF DESCRIPTION OF THE DRAWING

A more complete understanding of the present invention, however, may best be obtained by referring to the detailed description when considered in connection with the drawing figures, wherein like numerals denote like elements and wherein.

DETAILED DESCRIPTION OF EXEMPLARY EMBODIMENTS

The detailed description of exemplary embodiments of the invention herein shows various exemplary embodiments and the best modes known to the inventors at this time. These exemplary embodiments and modes are described in sufficient detail to enable those skilled in the art to practice the invention and are not intended to limit the scope, applicability, or configuration of the invention in any way. Rather, the following disclosure is intended to teach both the implementation of the exemplary embodiments and modes and any equivalent modes or embodiments that are known or obvious to those of reasonable skill in the art. Additionally, all included figures are non-limiting illustrations of the exemplary embodiments and modes, which similarly avail themselves to any equivalent modes or embodiments that are known or obvious to those of reasonable skill in the art.

The present invention relates generally to devices and methods for assisting archery bow hunters in making accurate shots while hunting in dynamic terrain. Generally, in accordance with various exemplary embodiments of the present invention, the present invention discloses various universal mounting brackets and integrated archery bow systems configured for coupling a support element to an archery bow. Most preferably, the universal mounting brackets and integrated archery bow systems are configured to give the bow hunter maximum stability and range of motion when aiming and/or firing the bow.

Figure 1:
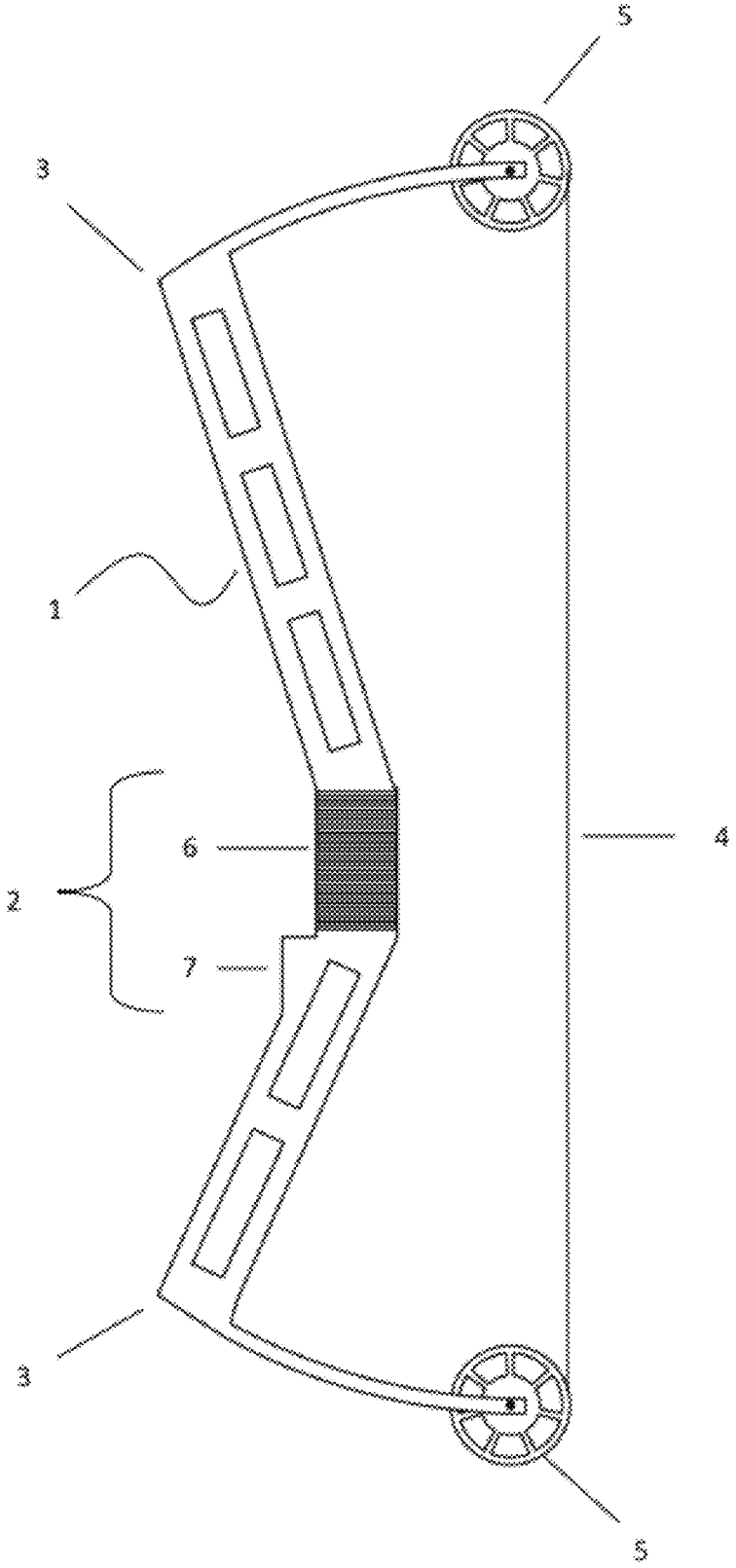
FIG. 1 illustrates a typical archery bow used for hunting and target practice in accordance with one exemplary embodiment of the present invention.

A standard archery bow, as illustrated in FIG. 1 and in accordance with the various exemplary embodiments of the present invention, typically has a main body 1 with a central riser 2 extending the length of the bow and ending at the limb bolts 3. These limb bolts 3 allow for after-market archery bow accessories to be attached to the main body 1 and denoted the beginning of the limbs, which are connected to each end of the main body 1. The limbs at the end of the main body 1, after the limb bolts 3, provide support for the wheels or cams 5, which in turn provide tension for an archery string 4 connecting the limbs. The archery string 4 is strung around and through two wheels or cams 5. The central riser 2 usually contains a hand grip 6 just below the mid-point of the central riser 2 and a standard bushing 7 just below the hand grip 6. The bushing 7 is usually a 5/16, #24 threaded bushing. The standard bushing 7 is also commonly called a stabilizer bushing and is used for mounting a stabilizer device, a support element, fishing line and reel, tracking string, or any other device or attachment.

As discussed above, the configuration and architecture of archery bows vary based on archery bow manufacture and personal modification by the archery bow hunter. Namely, the position, shape, and/or size of the main body 1 vary between each archery bow manufacturer and different models within a manufacture's own product line. Specifically, the shape of the central riser 2; the position of the limb bolts 3, the position and/or shape of the hand grip 6; and/or the position of the stabilizer bushing 7 may vary between each archery bow manufacturer and different models within a manufacture's own product line.

Figure 2:
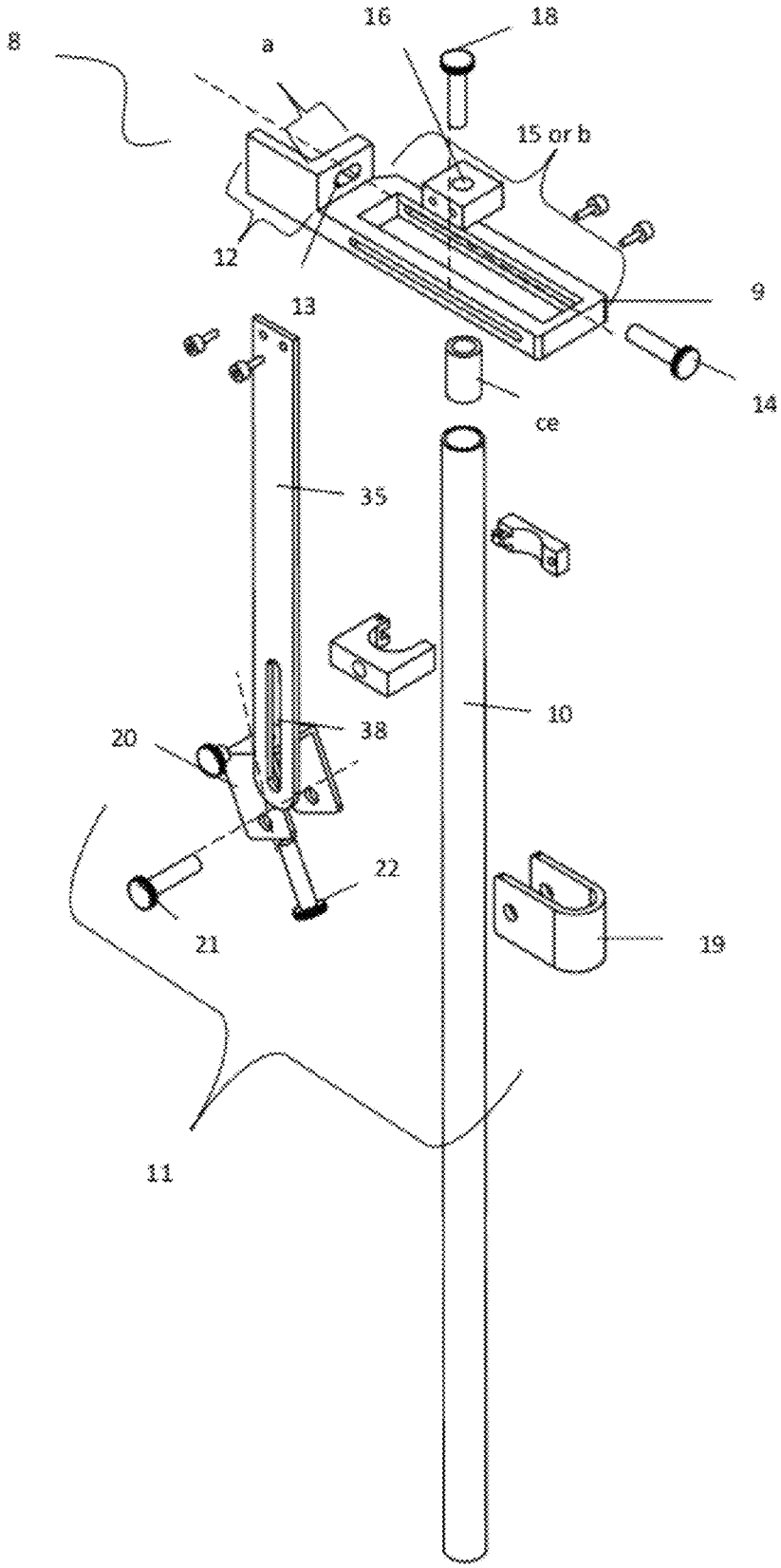
FIG. 2 illustrates a detailed drawing of a universal, front mounting bracket and monopod support element in accordance with an exemplary embodiment of the present invention.

Thus, each stabilization device and/or support element often requires specialized mounts for attachment to different archery bows. Accordingly, FIG. 2 illustrates, in accordance with the various exemplary embodiments of the present invention, a universal, mounting bracket and monopod support element 8 for use while aiming and/or firing an archery bow. Specifically, the universal, mounting bracket and monopod support element 8 may be moved such that the handle 2 of the archery bow, shown in FIG. 1, may be moved toward and away from the ground (allowing for increased or decreased arc overall shot). As shown in FIG. 2, in accordance with the various exemplary embodiments of the present invention, a mounting bracket (front) and monopod support element 8 comprises a mounting bracket 9 suitably configured to couple to the stabilizer bushing 7 (FIG. 1) and to a pole element 10. As discussed later herein, in accordance with the various exemplary embodiments of the present invention, mounting bracket 9 may be coupled to a collar element, "ce," configured to couple to the pole element 10. Optionally, in accordance with the various exemplary embodiments of the present invention, the universal, mounting bracket and monopod support element 8 may further comprise a pole stabilizing bracket 11 suitably configured to couple to the main body 1, preferably the limb bolts 3, to the pole element 10.

In accordance with the various exemplary embodiments of the present invention, the front mounting bracket and monopod support element 8 provides for a universally fitting, lightweight, stable, and adjustable support system assisting archery bow hunters in making accurate shots while hunting in dynamic terrain. Specifically, as illustrated in FIG. 2 and in accordance with the various exemplary embodiments of the present invention, the mounting bracket 9 comprises a 90 degree stabilizing lip 12 suitably configured to couple to the stabilizer bushing 7 (FIG. 1) and to provide maximum stability while the archery bow is fired. Preferably, in accordance with the various exemplary embodiments of the present invention, the length of the 90 degree stabilizing lip 12, as illustrated by the brackets and numerical reference 12, is long enough to maintain a rigid mounting bracket and monopod support element 8 while the archery bow is fired. Stated another way, in accordance with the various exemplary embodiments of the present invention, the length of the 90 degree stabilizing lip 12, as illustrated by the brackets and numerical reference 12, is long enough to provide adequate bracing as a torque force is exerted on the coupling between the stabilizer bushing 7 (FIG. 1) and the mounting bracket and monopod support element 8 due to the aiming and/or firing of the archery bow.

As illustrated in FIG. 2 and in accordance with the various exemplary embodiments of the present invention, the 90 degree stabilizing lip 12 is attached to the surface for coupling the mounting bracket 9 to the stabilizer bushing 7 (FIG. 1) and the 90 degree stabilizing lip 12 frames the central riser 2 (FIG. 1) of the archery bow.

Most preferably, in accordance with the various exemplary embodiments of the present invention, the length of the 90 degree stabilizing lip 12, as illustrated by the brackets and numerical reference 12, is equal to the width of the central riser 2 as illustrated in FIG. 1. By way of measurement, in accordance with the various exemplary embodiments of the present invention, the length of the 90 degree stabilizing lip 12 may be from about 0.75 inches to about 4 inches. Preferably, in accordance with the various exemplary embodiments of the present invention, the length of the 90 degree stabilizing lip 12 may be from about 1 inch to about 2 inches. Most preferably, in accordance with the various exemplary embodiments of the present invention, the length of the 90 degree stabilizing lip 12 may be about 1.5 inches.

One of reasonable skill in the art understands that any 90 degree stabilizing lip 12 length that provides adequate bracing and rigidity while the archery bow is fired is contemplated and disclosed herein.

Further, FIG. 2 illustrates, in accordance with the various exemplary embodiments of the present invention, the mounting bracket 9 comprising an adjustable stabilizing slot 13 to accommodate various main body 1 and central riser 2 sizes. Preferably, in accordance with the various exemplary embodiments of the present invention, the adjustable stabilizing slot 13 may comprise an elongated slot (likened to the adjustable slot shown later in FIG. 4 at numerical reference 27), suitably configured to slide the mounting bracket 9 about the stabilizer bushing 7 (FIG. 1) to ensure that the inside of the 90 degree stabilizing lip 12 is seated flush against the outside of main body 1 and/or central riser 2.

Additionally, in accordance with the various exemplary embodiments of the present invention the adjustable stabilizing slot 13 may comprise any size diameter or cross-section suitably configured to receive a 5/16, #24 stabilizer bolt. Preferably, the adjustable stabilizing slot 13 has a length of about 5/16 inches to about 1.5 inches. More preferably, in accordance with the various exemplary embodiments of the present invention the adjustable stabilizing slot 13 has a length of about 0.5 inches to about 1 inch. Most preferably, in accordance with the various exemplary embodiments of the present invention the adjustable stabilizing slot 13 has a length of about 0.75 inches.

Additionally, in accordance with the various exemplary embodiments of the present invention, the adjustable stabilizing slot 13 may comprise a diameter or cross-section that accommodates a bolt or hand nut 14 for coupling mounting bracket 9 to stabilizer bushing 7 (FIG. 1).

One of reasonable skill in the art understands that any type of bolt or hand nut 14 for coupling mounting bracket 9 to stabilizer bushing 7 (FIG. 1) is contemplated and disclosed herein.

By way of measurement, in accordance with the various exemplary embodiments of the present invention, the width of surface "a" for coupling to the stabilizer bushing 7 (FIG. 1), inside of the 90 degree stabilizing lip 12, the mounting bracket 9 may be from about 0.75 inches to about 2.5 inches. Preferably, in accordance with the various exemplary embodiments of the present invention, the width of surface "a" for coupling to the stabilizer bushing 7, inside of the 90 degree stabilizing lip 12, the mounting bracket 9 may be from about a 7/8 inch to about 2 inches. Most preferably, in accordance with the various exemplary embodiments of the present invention, the width of surface "a" for coupling to the stabilizer bushing 7, inside of the 90 degree stabilizing lip 12, the mounting bracket 9 may be about 1 inch.

Additionally, as illustrated in FIG. 2 and in accordance with the various exemplary embodiments of the present invention, the mounting bracket 9 comprises a bracket extension 15 suitably configured to couple to the pole element 10. Preferably, in accordance with the various exemplary embodiments of the present invention, the length of the bracket extension 15, as illustrated by the brackets and numerical reference 15, is long enough to provide adequate clearance of the main body 1 and/or limb bolt 3 of the archery bow.

Most preferably, in accordance with the various exemplary embodiments of the present invention, the length of the bracket extension 15, as illustrated by the brackets and numerical reference 15, may be any length allowing for shooting of the archery bow. By way of measurement, in accordance with the various exemplary embodiments of the present invention, the length of the bracket extension 15 may be from about 2 inches to about 10 inches. Preferably, in accordance with the various exemplary embodiments of the present invention, the length of the bracket extension 15 may be from about 4 inch to about 8 inches. Most preferably, in accordance with the various exemplary embodiments of the present invention, the length of the bracket extension 15 may be about 6 inches.

One of reasonable skill in the art understands that any length of bracket extension 15 suitable for shooting of an archery bow with various main body 1 and limb 3 geometries is contemplated and disclosed herein.

Further, FIG. 2 illustrates, in accordance with the various exemplary embodiments of the present invention, mounting bracket 9 comprising a hole 16 suitably configured to receive a bolt or hand nut 18 in order to couple pole element 10 to mounting bracket (front) 9. Optionally, in accordance with the various exemplary embodiments of the present invention, mounting bracket (front) 9 may be coupled to a collar element, labeled "ce," which couples to the top of pole element 10. Preferably, in accordance with the various exemplary embodiments of the present invention, the collar element, "ce," may comprise any press fitting (likened to collar element 25 shown in FIG. 4) suitable for coupling pole element 10 and any internal threaded portion suitable for receiving and coupling with bolt or hand nut 18.

In accordance with the various exemplary embodiments of the present invention, bracket extension 15 may comprise at least one of an adjustable slide configured to allow for adjustment of the distance between said pole element and said stabilizer bushing and an adjustable hole 16 suitably configured to adjust the distance "b" at which the pole element 10 is affixed from the width of surface "a" for coupling to the stabilizer bushing 7 (FIG. 1).

Optionally, in accordance with the various exemplary embodiments of the present invention, universal bracket extension 15 may comprise two parallel slots on the side surfaces of the bracket extension 15 and an open center. Thus, hole 16 may float and travel about the about two parallel slots on the side surfaces of the bracket extension 15, again allowing for the archer to adjust the distance "b" at which the pole element 10 is affixed from the width of surface "a."

Additionally, in accordance with the various exemplary embodiments of the present invention, hole 16 may comprise a diameter or cross-section that accommodates any bolt or hand nut 18 for coupling mounting bracket 9, particularly bracket extension 15, to pole element 10.

One of reasonable skill in the art understands that any type of bolt or hand nut 18 for coupling mounting bracket 9, particularly bracket extension 15, to pole element 10 is contemplated and disclosed herein.

Again in accordance with the various exemplary embodiments of the present invention and FIG. 2, the front mounted bracket and monopod support element 8 comprises a pole element 10. As discussed above, pole element 10 is coupled to the mounting bracket 9, particularly bracket extension 15, via hole 16 and bolt or hand nut 18. In accordance with the various exemplary embodiments of the present invention, pole element 10 may comprise at least one of a solid support pole element capable of supporting the weight of the archery bow on the ground while being fired and/or an adjustable pole element suitable for supporting the weight of the archery bow on the ground while being fired at different heights chosen by the archery hunter.

Generically, in accordance with the various exemplary embodiments of the present invention, pole element 10 may have a diameter of about ½ inch to about 1 inch. Preferably, in accordance with the various exemplary embodiments of the present invention the adjustable pole element 10 may have a diameter of about ⅝ to about ⅞. Most preferably, in accordance with the various exemplary embodiments of the present invention the pole element 10 may have a diameter of about ¾.

Further, in accordance with the various exemplary embodiments of the present invention, pole element 10 may have a total length of about 18 inches to about 5 feet. Preferably, in accordance with the various exemplary embodiments of the present invention the adjustable pole element 10 may have a length of about 2 feet to about 3 feet. Most preferably, in accordance with the various exemplary embodiments of the present invention the pole element 10 may have a length of about 34 inches.

Further, in accordance with the various exemplary embodiments of the present invention, the adjustable pole element 10 suitable for supporting the weight of the archery bow on the ground while being fired at different heights chosen by the archery hunter may comprise two or more telescoping pole segments (not shown) and a mechanism to adjust the height of pole support. For example, in accordance with the various exemplary embodiments of the present invention, the adjustable pole 10 may comprise a spring loaded mechanism to extend the pole, a shock (gas, air, etc.) mechanism to extend the pole, both mechanisms allowing the hunter to chose the optimal height for his shot.

Preferably, in accordance with the various exemplary embodiments of the present invention the adjustable pole element 10 suitable for supporting the weight of the archery bow on the ground while being fired at different heights chosen by the archery hunter may comprise two or more telescoping pole segments (not shown), wherein the first segment is larger in diameter than the second segment such that the second pole segment may be collapsed and stored inside the first pole segment and such that the second pole segment may be extended by unscrewing the second pole segment to loosen and release (likened to many telescoping poles know in the art, which are typically used for walking sticks, etc.). Once the second pole segment is extended to a desired height, it may then be locked in place for the hunter to attempt a shot with the archery bow.

One of reasonable skill in the art understands that many mechanisms exist in the prior art for actuating telescoping monopods (or support poles) and that all of these mechanisms (spring, gas, oil, air, etc.) and designs (two segment telescoping poles, three segment telescoping poles, etc.) are contemplated and disclosed herein.

Lastly, in accordance with the various exemplary embodiments of the present invention, the pole element 10 may comprise an expanded foot (not shown) further stabilizing the archery bow on ground during shooting.

Optionally, as shown in FIG. 2, in accordance with the various exemplary embodiments of the present invention, the mounting bracket and monopod support element 8 may comprises a pole stabilizing bracket 11 suitably configured to couple to the main body 1, preferably the limb bolts 3, to the pole element 10. One of reasonable skill in the art will note that the pole stabilizing bracket 11 may be any configuration and/or geometry allowing for attachment the main body of an archery bow and that any such configuration and/or geometry is disclosed and contemplated herein.

As shown in FIG. 2, in accordance with the various exemplary embodiments of the present invention, the pole stabilizing bracket 11 may comprise a pole stabilizer 19 for coupling the pole element 10 to the body connecter 20, thereby providing a second stabilizing point of attachment. One of reasonable skill in the art will note that the pole stabilizer 19 and the body connecter 20 may be constructed out of a single part and that any such configuration and/or geometry is disclosed and contemplated herein.

Preferably, in accordance with the various exemplary embodiments of the present invention, the pole stabilizer 19 comprises a bracket for holding the pole element 10 and a receiving hole/slot for accommodating bolt or hand nut 21. As shown in FIG. 2 and in accordance with the various exemplary embodiments of the present invention, bolt or hand nut 21 detachably couples pole stabilizer 19 to body connecter 20. Additionally, in a preferred embodiment of the present invention, body connecter 20 comprises a receiving hole/slot for accommodating bolt or hand nut 22, wherein the bolt or hand nut 22 (this bolt is commonly referred to as the "limb bolt") couples the body connecter 20 to the main body 1, preferably the limb bolt 3 of the archery bow.

One of reasonable skill in the art will note that various configurations and/or geometries for the body connecter 20 and all configurations and/or geometries suitable for connecting the main body 1, preferably the limb bolt 3 of the archery bow to the pole stabilizer 19 are contemplated herein. Additionally, one of reasonable skill in the art understands that any means for coupling the body connecter 20 to a main body 1, preferably the limb bolt 3, of the archery bow are contemplated and disclosed herein.

Figure 3:
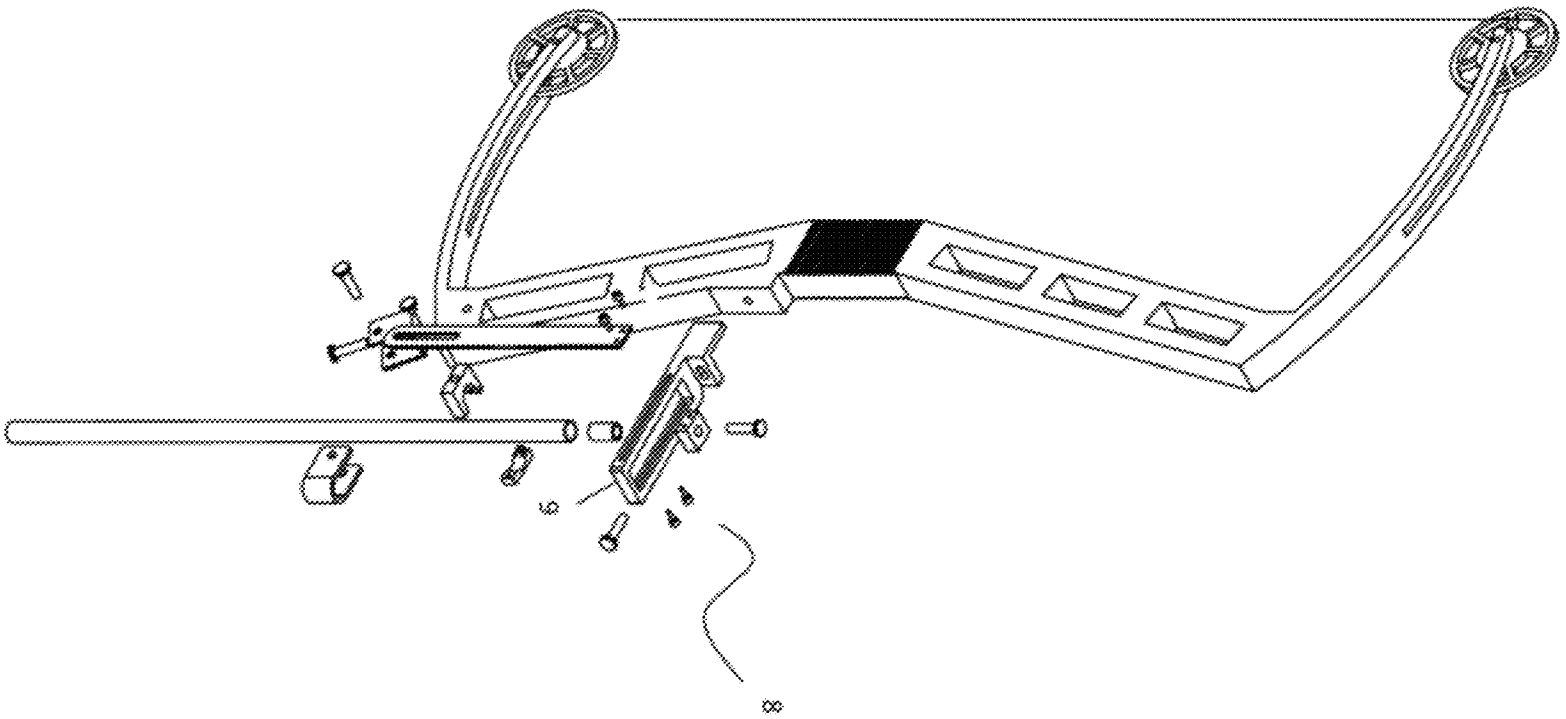
FIG. 3 illustrates a detailed drawing of a universal, front mounting bracket with monopod support element coupled to an archery bow in accordance with an exemplary embodiment of the present invention.

FIG. 3 illustrates, in accordance with the various exemplary embodiments of the present invention, how the mounting bracket (front) and monopod support element 8 couples to the archery bow (as shown in FIG. 1).

Figure 4:
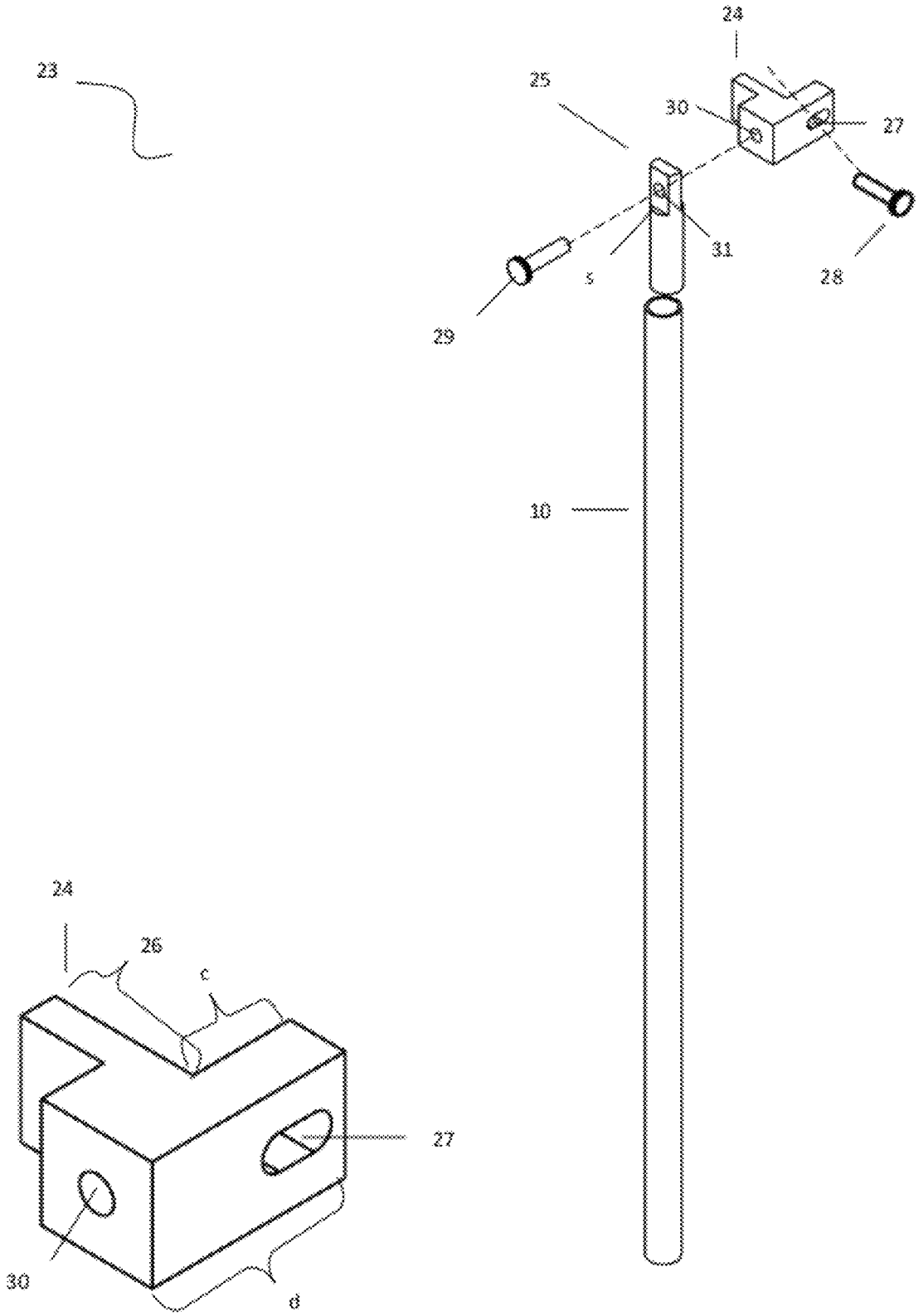
FIG. 4 illustrates a detailed drawing of a universal, side mounting bracket and monopod support element in accordance with an exemplary embodiment of the present invention.

Alternatively, FIG. 4 illustrates, in accordance with the various exemplary embodiments of the present invention, a universal, side mounting bracket and monopod support element 23 for use while aiming and/or firing an archery bow. Specifically, the universal, side mounting bracket and monopod support element 23 may be moved such that the handle 2 of the archery bow, shown in FIG. 1, may be moved toward and away from the ground (allowing for increased or decreased arc overall shot). As shown in FIG. 4, in accordance with the various exemplary embodiments of the present invention, the side mounted bracket and monopod support element 23 comprises a mounting bracket (side) 24 suitably configured to couple to the stabilizer bushing 7 (FIG. 1) and to either directly to a pole element 10, or, optionally, to a collar element 25 suitably configured to couple the pole element 10 to the mounting bracket (side) 24.

In accordance with the various exemplary embodiments of the present invention, the universal, side mounting bracket and monopod support element 23 provides for a universally fitting, lightweight, stable, and adjustable support system assisting archery bow hunters in making accurate shots while hunting in dynamic terrain. Specifically, as illustrated in FIG. 4 and in accordance with the various exemplary embodiments of the present invention, the mounting bracket (side) 24 comprises a 90 degree stabilizing lip 26 suitably configured to couple to the stabilizer bushing 7 (FIG. 1) and to provide maximum stability while the archery bow is held in the firing position and/or fired. Preferably, in accordance with the various exemplary embodiments of the present invention, the length of the 90 degree stabilizing lip 26, as illustrated by the brackets and numerical reference 26, is long enough to maintain a rigid universal, side mounting bracket and monopod support element 23 while the archery bow is being aimed and/or fired. Stated another way, in accordance with the various exemplary embodiments of the present invention, the length of the 90 degree stabilizing lip 26, as illustrated by the brackets and numerical reference 26, is long enough to provide adequate bracing as a torque force is exerted on the coupling between the stabilizer bushing 7 (FIG. 1) and the universal, side mounting bracket and monopod support element 23 due to the firing and/or the aiming of the archery bow.

Most preferably, in accordance with the various exemplary embodiments of the present invention, the length of the 90 degree stabilizing lip 26, as illustrated by the brackets and numerical reference 26, is about equal to the width of the central riser 2 as illustrated in FIG. 1. By way of measurement, in accordance with the various exemplary embodiments of the present invention, the length of the 90 degree stabilizing lip 26 may be from about 1 inch to about 4 inches. Preferably, in accordance with the various exemplary embodiments of the present invention, the length of the 90 degree stabilizing lip 26 may be from about 1 inch to about 3 inches. Most preferably, in accordance with the various exemplary embodiments of the present invention, the length of the 90 degree stabilizing lip 26 may be about 2 inches.

One of reasonable skill in the art understands that any 90 degree stabilizing lip 26 length that provides adequate bracing and rigidity while the archery bow is aimed and/or fired is contemplated and disclosed herein.

Further, FIG. 4 illustrates, in accordance with the various exemplary embodiments of the present invention, the universal, side mounting bracket 24 comprising an adjustable stabilizing slot 27 to accommodate various main body 1 and central riser 2 sizes. Preferably, in accordance with the various exemplary embodiments of the present invention, the adjustable stabilizing slot 27 may comprise an elongated slot, as shown, suitably configured to slide the universal, side mounting bracket 24 about the stabilizer bushing 7 (FIG. 1) to ensure that the 90 degree stabilizing lip 26 and surface "c" are seated flush against the stabilizer bushing 7 (FIG. 1) and the central riser 2, simultaneously.

Additionally, in accordance with the various exemplary embodiments of the present invention the adjustable stabilizing slot 27 may comprise any size diameter or cross-section suitably configured to receive a 5/16, #24 stabilizer bolt. Preferably, the adjustable stabilizing slot 27 has a length of about 5/16 inches to about 1.5 inches. More preferably, in accordance with the various exemplary embodiments of the present invention the adjustable stabilizing slot 27 has a length of about 0.5 inches to about 1 inch. Most preferably, in accordance with the various exemplary embodiments of the present invention the adjustable stabilizing slot 27 has a length of about 0.75 inches.

One of reasonable skill in the art understands that any type of bolt or hand nut 28 for coupling universal, side mounting bracket 24 to stabilizer bushing 7 (FIG. 1) is contemplated and disclosed herein.

By way of measurement, in accordance with the various exemplary embodiments of the present invention, the width of surface "c" for coupling to the stabilizer bushing 7 (FIG. 1), inside of the 90 degree stabilizing lip 26, the mounting bracket (side) 24 may be from about 1 inch to about 5 inches. Preferably, in accordance with the various exemplary embodiments of the present invention, the width of surface "c" for coupling to the stabilizer bushing 7 (FIG. 1), inside of the 90 degree stabilizing lip 26, the mounting bracket (side) 24 may be from about 1.5 inches to about 3 inches. Most preferably, in accordance with the various exemplary embodiments of the present invention, the width of surface "c" for coupling to the stabilizer bushing 7 (FIG. 1), inside of the 90 degree stabilizing lip 26, the mounting bracket (side) 24 may be about 1 inches.

Additionally, as illustrated in FIG. 4 and in accordance with the various exemplary embodiments of the present invention, the mounting bracket (side) 24 may comprise hole 30 configured to couple either to pole element 10 or to, optionally, collar element 25 via accommodating a bolt or hand nut 29. One of reasonable skill in the art understands that any type of bolt or hand nut 29 for coupling mounting bracket (FIG. 1) 24 to either to pole element 10 or to, optionally, collar element 25 is contemplated and disclosed herein.

By way of measurement, in accordance with the various exemplary embodiments of the present invention, the overall width, "d" of the mounting bracket (side) 24 (from attachment at the stabilizer bushing 7 (FIG. 1) to attachment at either the pole element 10 or, optionally, collar element 25) may be from about 1 inch to about 5 inches. Preferably, in accordance with the various exemplary embodiments of the present invention, the overall width, "d," of the mounting bracket (side) 24 may be from about 1.5 inches to about 3 inches. Most preferably, in accordance with the various exemplary embodiments of the present invention, the overall width, "d," of the mounting bracket (side) 24 may be about 2.25 inches.

As illustrated in FIG. 4 and in accordance with the various exemplary embodiments of the present invention, optionally, collar element 25 is suitably configured to attach to the pole element 10 and to receive bolt or hand nut 29 via collar slot 31. Preferably, in accordance with the various exemplary embodiments of the present invention, the optionally, collar element 25 is fastened to pole element 10 by at least one of a press fitting, internal or external threading, a clip, and/or any suitable fastener.

Preferably, in accordance with the various exemplary embodiments of the present invention, the collar element 25 may comprise any geometry suitably configured to provide a support piece, "s," for the mounting bracket (side) 24. This allows the weight of the archery bow to be transferred to pole element 10 and subsequently to the ground. Most preferably, as show in FIG. 6 and in accordance with the various exemplary embodiments of the present invention, the collar element 25 may comprise any press fitting suitable for coupling pole element 10, a flat support surface, "s," for supporting the mounting bracket (side) 24, and any threaded portion suitable for receiving and coupling with bolt or hand nut 18.

One of reasonable skill in the art understands that many types and means of fastening, optionally, collar element 25 to pole element 10 are known in the art and that any means for coupling is contemplated and disclosed herein.

As discussed above, pole element 10 is coupled either to, optionally, collar element 25 collar hole 31 and bolt or hand nut 29 or to pole element 10 via the support hole 30 and bolt or hand nut 29. In accordance with the various exemplary embodiments of the present invention, pole element 10 may comprise at least one of a solid support pole capable of supporting the weight of the archery bow on the ground while being fired and/or an adjustable pole suitable for supporting the weight of the archery bow on the ground while being fired at different heights chosen by the archery hunter.

In accordance with the various exemplary embodiments of the present invention, pole element 10 may comprises a diameter of about ½ inch to about 1 inch. Preferably, in accordance with the various exemplary embodiments of the present invention, pole element 10 may comprises a diameter of about ⅝ inch to about ⅞ inch. Most preferably, in accordance with the various exemplary embodiments of the present invention the pole element 10 may comprises a diameter of about ¾ inch.

Further, in accordance with the various exemplary embodiments of the present invention, pole element 10 may have a total length of about 18 inches to about 5 feet. Preferably, in accordance with the various exemplary embodiments of the present invention the adjustable pole element 10 may have a length of about 18 inches to about 3 feet. Most preferably, in accordance with the various exemplary embodiments of the present invention the pole element 10 may have a length of about 34 inches.

Further, in accordance with the various exemplary embodiments of the present invention, the adjustable pole element 10 suitable for supporting the weight of the archery bow on the ground while being fired at different heights chosen by the archery hunter may comprise two or more telescoping pole segments (not shown) and a mechanism to adjust the height of pole support. For example, in accordance with the various exemplary embodiments of the present invention, the adjustable pole 10 may comprise a spring loaded mechanism to extend the pole, a shock (gas, air, etc.) mechanism to extend the pole, both mechanisms allowing the hunter to choose the optimal height for his shot.

Preferably, in accordance with the various exemplary embodiments of the present invention the adjustable pole element 10 suitable for supporting the weight of the archery bow on the ground while being fired at different heights chosen by the archery hunter may comprise two telescoping pole segments (not shown), wherein the first segment is larger in diameter than the second segment such that the second pole segment may be collapsed and stored inside the first pole segment and such that the second pole segment may be extended by unscrewing the second pole segment to loosen and release (likened to many telescoping poles know in the art, which are typically used for walking sticks, etc.). Once the second pole segment is extended to a desired height, it may then be locked in place for the hunter to attempt a shot with the archery bow.

One of reasonable skill in the art understands that many mechanisms exist in the prior art for actuating telescoping monopods (or support poles) and that all of these mechanisms (spring, gas, oil, air, etc.) and designs (two segment telescoping poles, three segment telescoping poles, etc.) are contemplated and disclosed herein.

Lastly, in accordance with the various exemplary embodiments of the present invention, the pole element 10 may comprise an expanded foot (not shown) further stabilizing the archery bow on ground during shooting.

Figure 5:
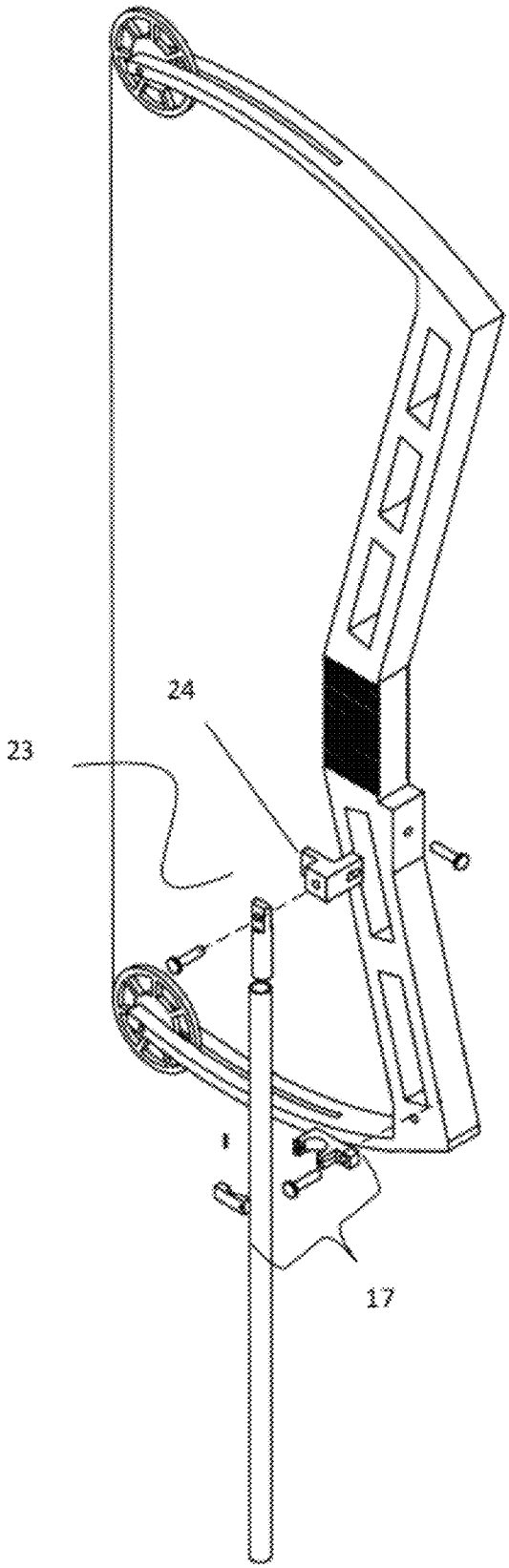
FIG. 5 illustrates a detailed drawing of a universal, side mounting bracket with monopod support element coupled to an archery bow in accordance with an exemplary embodiment of the present invention.

FIG. 5 illustrates, in accordance with the various exemplary embodiments of the present invention, how the universal, side mounted bracket and monopod support element 23 attaches to the archery bow (as shown in FIG. 1).

Optionally, as shown in FIG. 5, in accordance with the various exemplary embodiments of the present invention, the mounting bracket (side) 24 may comprises a pole stabilizing bracket 17 suitably configured to couple to the main body 1 to the pole element 10. As noted above, in a preferred embodiment of the present invention, this pole stabilizing bracket 17 is intended to provide a second point of attachment to the archery bow riser/main body for additional stability. One of reasonable skill in the art will note that the pole stabilizing bracket 17 may be any configuration and/or geometry allowing for attachment the main body of an archery bow and that any such configuration and/or geometry is disclosed and contemplated herein.

As shown in FIG. 5, in accordance with the various exemplary embodiments of the present invention, the pole stabilizing bracket 17, likened to pole stabilizing bracket 11 described above, may comprise any means for detachably coupling the pole element 10 to the main body 1 of the archery bow. By way of non-limiting example, the pole stabilizing bracket 17 is preferably bolted to the archery bow vis-à-vis a opening in the body of the archery bow. One of reasonable skill in the art will note that the pole stabilizing bracket 17 may be coupled to the archery bow by any means allowing for a second point of attachment.

Figure 6:
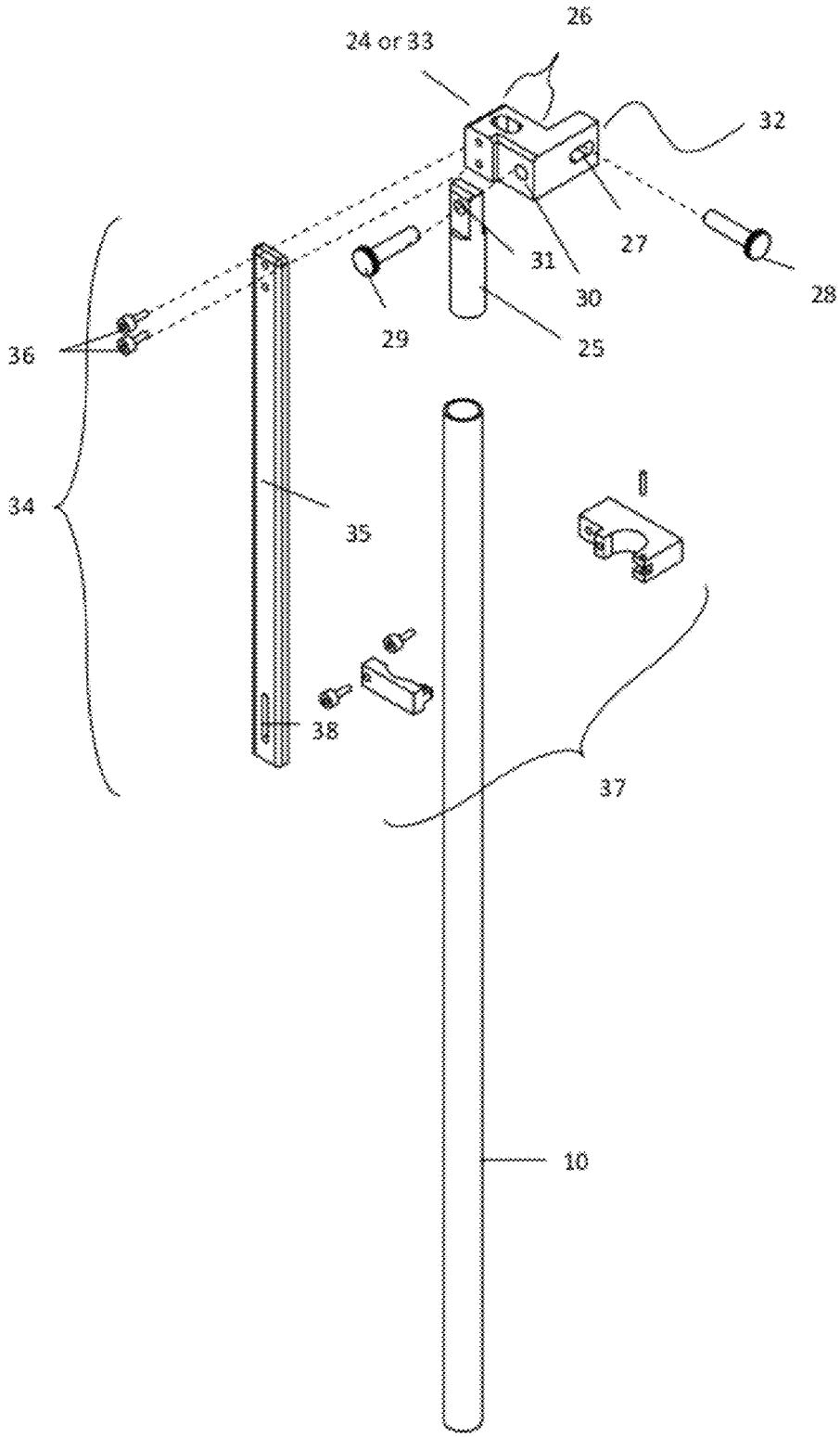
FIG. 6 illustrates a detailed drawing of a universal, side mounting bracket with pole stabilizer support and monopod support element in accordance with an exemplary embodiment of the present invention.

In an alternative exemplary embodiment, FIG. 6 illustrates, in accordance with the various exemplary embodiments of the present invention, the mounting bracket with pole stabilizer support and monopod support element 32 for use while aiming and/or firing an archery bow. Specifically, the mounting bracket with pole stabilizer support and monopod support element 32 may be moved such that the handle 2 of the archery bow, shown in FIG. 1, may be moved toward and away from the ground (allowing for increased or decreased arc overall shot). As shown in FIG. 6, in accordance with the various exemplary embodiments of the present invention, the side mounted bracket and monopod support element 32 comprises the mounting bracket 33, as described above with reference to numerical reference 24, suitably configured to couple to the stabilizer bushing 7 (FIG. 1) and to either a pole element 10, or, optionally, a collar element 25 suitably configured to couple the pole element 10 to the side mounting bracket 33, and a pole stabilizer support element 34.

As disclosed above, in accordance with the various exemplary embodiments of the present invention, universal, side mounting bracket 33 or 24 may comprise a 90 degree stabilizing lip 26 suitably configured to couple to the stabilizer bushing 7 (FIG. 1) and to provide maximum stability, an adjustable stabilizing slot 27 may comprise a diameter or cross-section that accommodates a bolt or hand nut 28 for coupling universal, side mounting bracket 33 or 24 to stabilizer bushing 7 (FIG. 1), and support hole 30 configured to couple either directly to pole element 10 or, optionally, to collar element 25 via accommodating a bolt or hand nut 29, wherein the optionally, collar element 25 may be suitably configured to attach to the pole element 10 and to receive bolt or hand nut 29 via collar hole 31.

Preferably, in accordance with the various exemplary embodiments of the present invention, the collar element 25 may comprise any geometry suitably configured to provide a support piece, "s," (not labeled) for the mounting bracket 33 or 24. This allows the weight of the archery bow to be transferred to pole element 10 and subsequently to the ground. Most preferably, as show in FIG. 6 and in accordance with the various exemplary embodiments of the present invention, the collar element 25 may comprise any press fitting suitable for coupling pole element 10, a flat support surface, "s," (not labeled) for supporting the mounting bracket 33 or 24, and any threaded portion suitable for receiving and coupling with bolt or hand nut 18.

Additionally, as illustrated in FIG. 6 and in accordance with the various exemplary embodiments of the present invention, mounting bracket 33 or 24 may comprise a secondary pole stabilizer support system 34. As illustrated in FIG. 6 and in accordance with the various exemplary embodiments of the present invention, the secondary pole stabilizer support system 34 may comprise a stabilizer bar 35 configured to couple to the mounting bracket 33 or 24 and to the pole element 10. Preferably, as shown in FIG. 6 and in accordance with the various exemplary embodiments of the present invention, the universal, side mounting bracket 33 or 24 and the stabilizer bar 35 may be one fabricated piece. Alternatively, it is within the scope of this invention that the mounting bracket 33 or 24 and the stabilizer bar 35 are fabricated in two separate pieces and coupled together by any means known in the art, including, but not limited to bolts, hand nuts, and or internal/external threads. One of reasonable skill in the art understands that many different means are known in the art for coupling or fastening two fabricated pieces together and that any of these means for are contemplated and disclosed herein.

Preferably, as shown in FIG. 6 and in accordance with the various exemplary embodiments of the present invention, the stabilizer bar 34 is coupled to the pole element 10 with a collar element 37. In accordance with the various exemplary embodiments of the present invention, the collar element 37 may be configured to slide on an adjustable track 38 laterally up and down pole element 10 and stabilizer bar 34 may be attached to mounting bracket 33 or 24 with one or more bolt or hand nut 36. One of reasonable skill in the art understands that any type of bolt or hand nut 36 for coupling the stabilizer bar 35 to mounting bracket 33 or 24 is contemplated and disclosed herein. Additionally, in accordance with the various exemplary embodiments of the present invention, the stabilizer bar 35 may comprise any length, size diameter, or cross-section.

Further, in accordance with the various exemplary embodiments of the present invention, the stabilizer bar 35 may have any length suitable for providing pole element 10 with maximum stability. Preferably, in accordance with the various exemplary embodiments of the present invention, the stabilizer bar 35 may have a length of about 4 inches to about 16 inches. More preferably, in accordance with the various exemplary embodiments of the present invention, the stabilizer bar 35 may have a length of about 6 inches to about 14 inches. Most preferably, in accordance with the various exemplary embodiments of the present invention, the stabilizer bar 35 may have a length of about 12 inches.

Additionally, in accordance with the various exemplary embodiments of the present invention the adjustable slot 38 may comprise any size, diameter, length and/or cross-section. Preferably, the adjustable slot 38 comprises a length of about 2 inches to about 6 inches. More preferably, in accordance with the various exemplary embodiments of the present invention, the adjustable slot 38 comprises a length of about 3 inches to about 5 inches. Most preferably, in accordance with the various exemplary embodiments of the present invention, the adjustable slot 38 comprises a length of about 4 inches.

Figure 7:
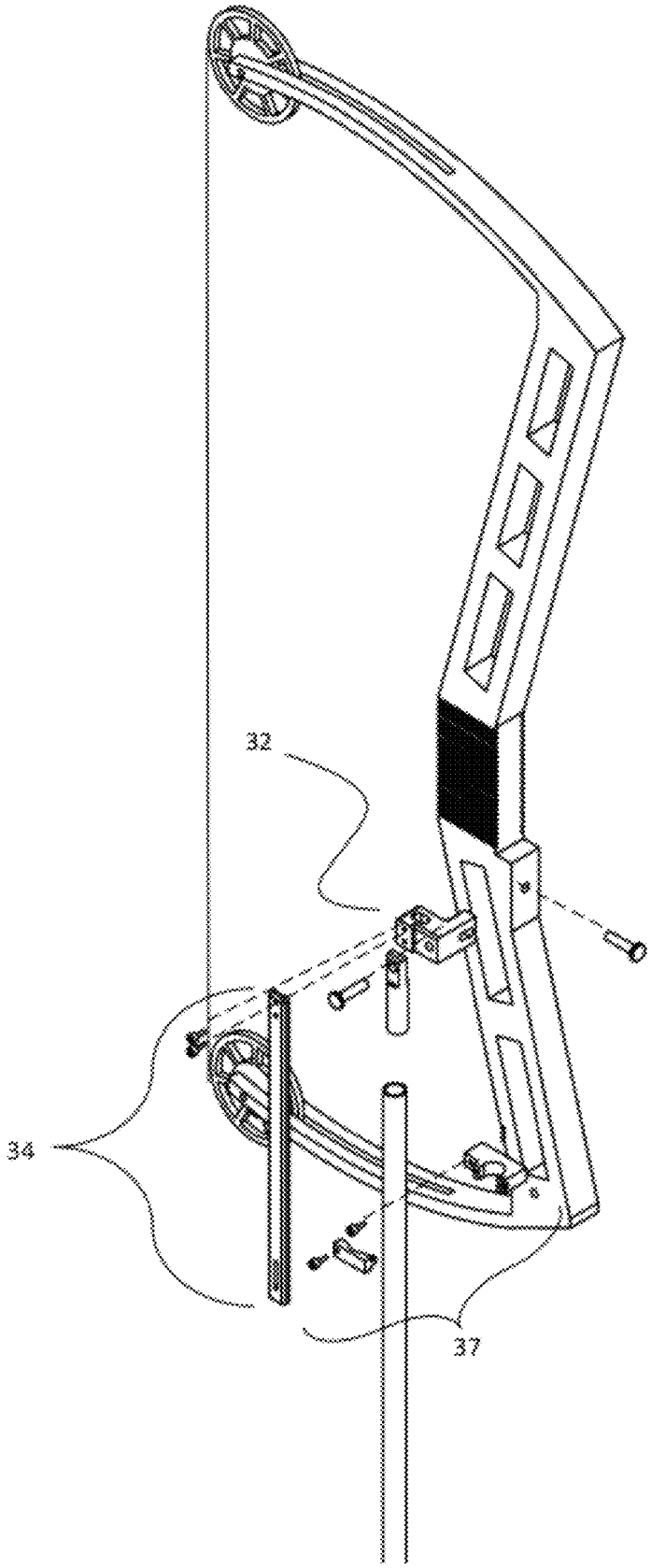
FIG. 7 illustrates a detailed drawing of a universal, side mounting bracket with pole stabilizer support and monopod support element coupled to an archery bow in accordance with an exemplary embodiment of the present invention.

FIG. 7 illustrates, in accordance with the various exemplary embodiments of the present invention, how the mounting bracket with pole stabilizer support system and monopod support element 32 attaches to the archery bow (as shown in FIG. 1).

Figure 8:
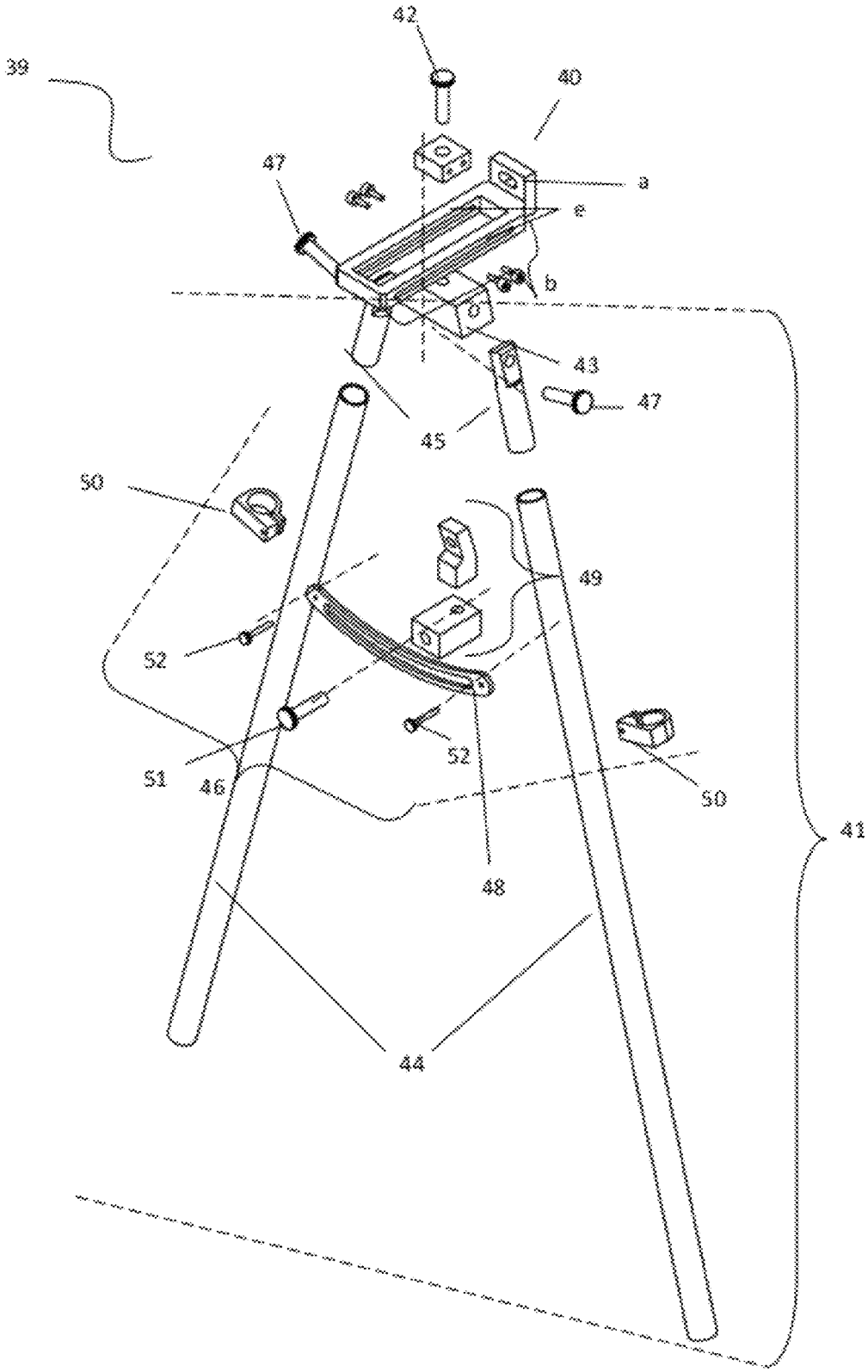
FIG. 8 illustrates a detailed drawing of a universal, front mounting bracket and bipod support element in accordance with an exemplary embodiment of the present invention.

Additionally, FIG. 8 illustrates, in accordance with the various exemplary embodiments of the present invention, a universal, front mounting bracket and bipod support element 39 for use while aiming and/or firing an archery bow. As shown in FIG. 8, in accordance with the various exemplary embodiments of the present invention, the mounting bracket and bipod support element 39 comprises a mounting bracket 40 suitably configured to couple to the stabilizer bushing 7 (FIG. 1) and to a bipod stand 41.

As shown in FIG. 8 and in accordance with the various exemplary embodiments of the present invention, the mounting bracket 40 may comprise any width of the mounting bracket 40 suitable for coupling to the stabilizer bushing 7 (FIG. 1) of any archery bow. Moreover, in accordance with the various exemplary embodiments of the present invention, the mounting bracket 40 may comprise a stabilizer hole suitably configured to couple the mounting bracket 40 to the stabilizer bushing 7 (FIG. 1) to ensure that one sized mounting bracket 40 can be used for all archery bow geometries and types (i.e. that the mounting bracket 40 is universal).

Preferably, in accordance with the various exemplary embodiments of the present invention, the width of mounting bracket 40 may be about ¾ inch to about 2 inches. More preferably, in accordance with the various exemplary embodiments of the present invention, the width of the mounting bracket 40 may be from about 1 inch to about 1.5 inches. Most preferably, in accordance with the various exemplary embodiments of the present invention, the width of universal, front mounting bracket 40 may be about 1.25 inch.

Additionally, as shown in FIG. 8 and in accordance with the various exemplary embodiments of the present invention, the mounting bracket 40 may be coupled to the stabilizer bushing 7 (FIG. 1) via a bolts or hand nuts (not shown). Preferably, any bolt allowing for axial movement (movement about the axis of the bolt itself) of the archery bow while maintaining mounting bracket 40 securely attached to the stabilizer bushing 7 is disclosed. Most preferably, mounting bracket 40 is coupled to the stabilizer bushing 7 with a compression fitting allowing for this axial movement without loosening of the mounting bracket 40.

As shown in FIG. 8 and in accordance with the various exemplary embodiments of the present invention, the mounting bracket 40 may be coupled to a bipod stand 41 via bolt or hand nut 42. One of reasonable skill in the art understands that any type of bolt or hand nut 42 for coupling the mounting bracket 40 to the brace 43 is contemplated and disclosed herein.

Optionally, likened to universal bracket extension 15, in accordance with the various exemplary embodiments of the present invention, the mounting bracket 40 may comprise two parallel slots on the side surfaces, "e," of the mounting bracket 40 and an open center. Thus, hole configured for accommodating bolt or hand nut 42 may float and travel about the about two parallel slots on the side surfaces, "e," of the mounting bracket 40, again allowing for the archer to adjust the distance "b" at which the pole element 10 is affixed from the width of surface "a" for coupling to the stabilizer bushing 7.

Moreover, as shown in FIG. 8 and in accordance with the various exemplary embodiments of the present invention, the bipod stand 41 comprises a brace 43 suitably configured to couple the mounting bracket 40 and either directly to the two pole elements 44 or, optionally, to a collar element 45 suitably configured to couple to two pole elements 44, and, optionally, a bow guide 46 configured to couple to the main body 1, preferably the limb bolt 3, to the two pole elements 44. Further, in accordance with the various exemplary embodiments of the present invention, the brace 43 may be coupled to two pole elements 44 with two slide bolts or hand nuts 47.

As discussed above, in accordance with the various exemplary embodiments of the present invention, pole elements 44 may comprise all of the embodiments as taught for pole element 10 in the preceding figures and description. Additionally, in accordance with the various exemplary embodiments of the present invention, collar element 45 may comprise all of the embodiments as taught for collar element 25 in the preceding figures and description.

Optionally, as shown in FIG. 8 and in accordance with the various exemplary embodiments of the present invention, the universal, front mounting bracket and bipod support element 39 may comprise a bow guide 46 suitably configured to couple to the main body 1, preferably the limb bolt 3, to the pole elements 44. As noted above, this bow guide 46 is optional and is intended to provide a second point of attachment to the archery bow for additional stability, but is not necessary for the function of universal, front mounting bracket and bipod support element 39. One of reasonable skill in the art will note that the bow guide 46 may be any configuration and/or geometry allowing for attachment the main body of an archery bow and that any such configuration and/or geometry is disclosed and contemplated herein.

Preferably, as shown in FIG. 8 and in accordance with the various exemplary embodiments of the present invention, bow guide 46 comprises a slide 48 configured for receiving a body bracket 49 configured to be coupled to the main body 1, preferably the limb bolt 3, to provide a second stabilizing point of attachment, at least two pole connectors 50, a slide bolt or hand nut 51, and at least two pole bolts or hand nuts 52.

As discussed above, in accordance with the various exemplary embodiments of the present invention, the at least two pole connectors 50 may comprise all of the embodiments as taught for collar element 37 in the preceding figures and description.

Figure 9:
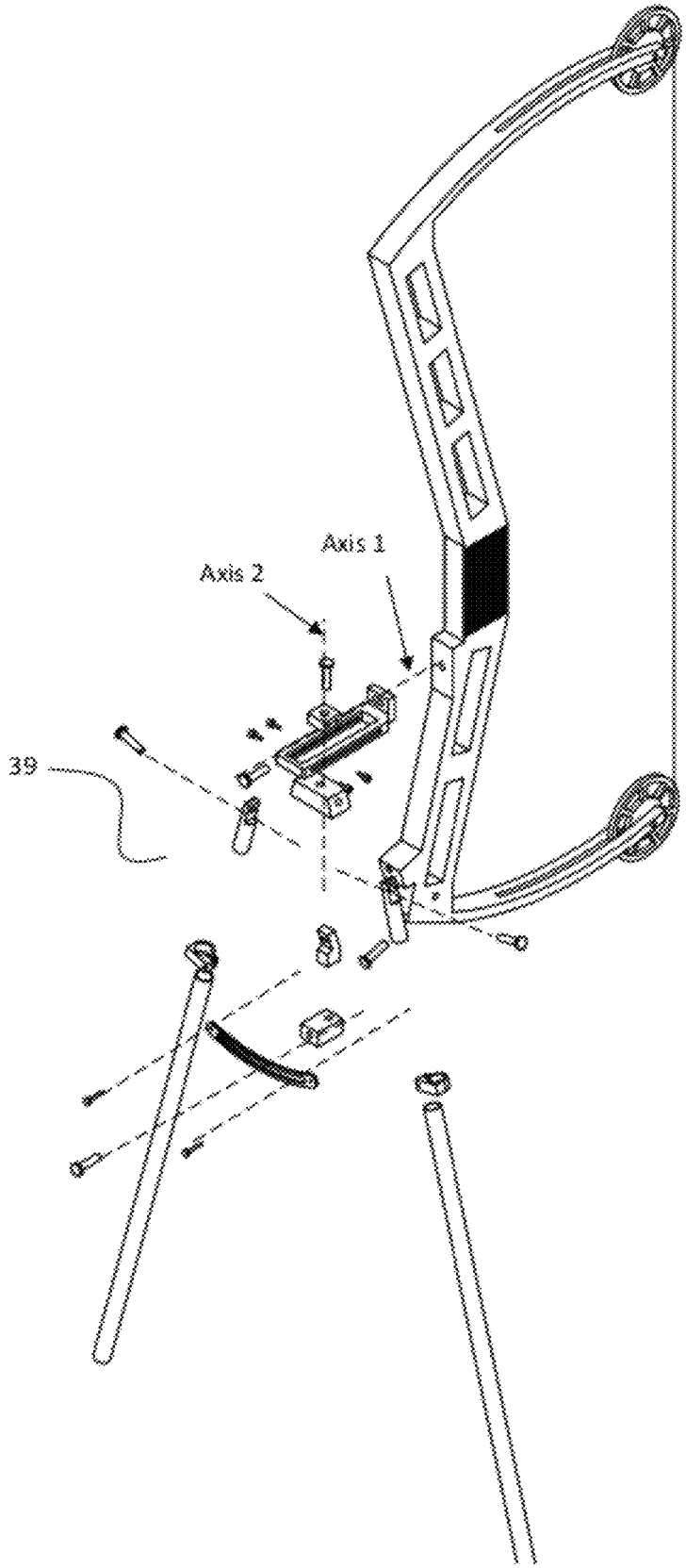
FIG. 9 illustrates a detailed drawing of a universal, front mounting bracket with bipod support element coupled to an archery bow in accordance with an exemplary embodiment of the present invention.

FIG. 9 illustrates, in accordance with the various exemplary embodiments of the present invention, the universal, front mounting bracket and bipod support element 39 is configured to give the bow hunter maximum stability and range of motion when aiming and/or firing the bow. Specifically, in accordance with the various exemplary embodiments of the present invention, the universal, front mounting bracket and bipod support element 39 is configured to allow the archery bow to be moved axially (movement about the axis of the bolt coupling the universal, front mounting bracket and bipod support element 39 to the stabilizer bushing 7 (FIG. 1)—labeled in "Axis 1" in FIG. 9), may be moved axially about the axis of bolt or hand nut 42 (labeled in "Axis 2" in FIG. 9) for coupling the universal, front mounting bracket 40 to the brace 43, and may be moved such that the handle 2 of the archery bow, shown in FIG. 1, may be moved toward and away from the ground (allowing for increased or decreased arc overall shot). As shown in FIG. 8, in accordance with the various exemplary embodiments of the present invention, with optional bow guide 46, the universal, front mounting bracket and bipod support element 39 is configured to allow the archery bow to swivel axially about the bolt coupling the universal, front mounting bracket and bipod support element 39 to the stabilizer bushing 7 (as shown by the path of the slide 48 within the bow guide 46) and the archery bow can be tilted forward and backwards to make difficult shots on dynamic terrain.

Figure 10:
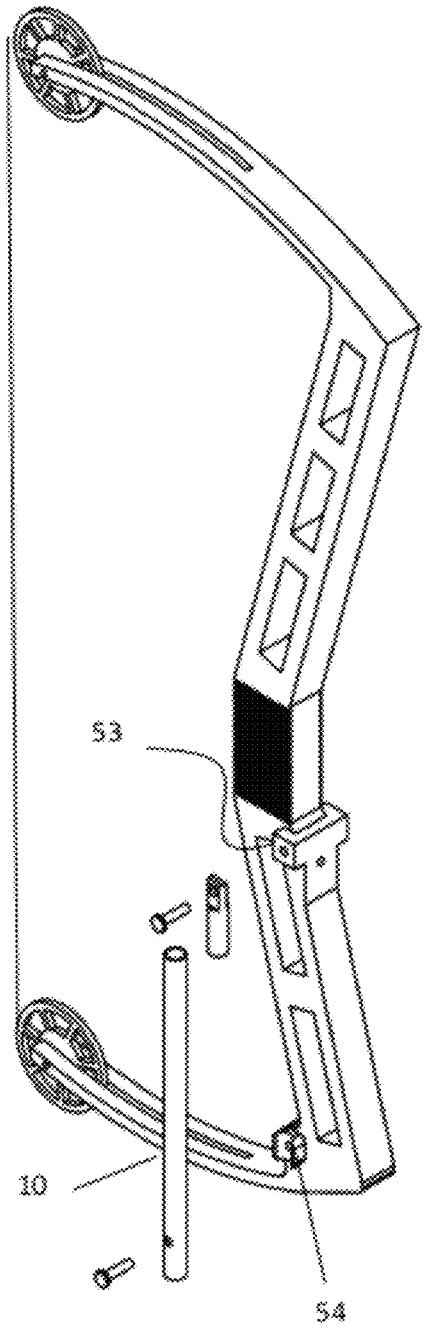
FIG. 10 illustrates a detailed drawing of an integrated archery system with a universal, side boss and monopod support element in accordance with an exemplary embodiment of the present invention.

FIG. 10 illustrates, in accordance with the various exemplary embodiments of the present invention, a riser boss with monopod support element for use while aiming and/or firing an archery bow. Specifically, in accordance with the various exemplary embodiments of the present invention, the riser boss 53 is essentially the universal, side mounting bracket and monopod support element 23, as shown in FIG. 4, integrated into the central riser 2 of the archery bow.

Preferably, in accordance with the various exemplary embodiments of the present invention, the riser boss 53 is accompanied with a lower riser boss 54 extending from the main body 1 at around the location of the limb bolt 3. As illustrated FIG. 10 and in accordance with the various exemplary embodiments of the present invention, the lower riser boss 54 couples to the pole element 10 to provide a second stabilization point of attachment.

One of reasonable skill in the art will note that the universal, side boss 53 and the universal lower riser boss 54 may be any configuration and/or geometry allowing for attachment a support element to the main body of an archery bow and that any such configuration and/or geometry is disclosed and contemplated herein.

One of reasonable skill in the art understands that all of the above exemplary embodiments of this invention can be manufactured from multiple different materials and that all material known in the art suitable for producing all embodiments herein as described above, both in the detailed description of the invention and in the figures is contemplated and taught herein. Preferably, in accordance with the various exemplary embodiments of the present invention, all of the parts disclosed herein are produced from at least one of a plastic, metal, fiberglass, carbon/graphite, nylon, and/or a ceramic material.

Moreover, unless specifically noted, it is the Applicant's intent that the words and phrases in the specification and the claims be given the commonly accepted generic meaning or an ordinary and accustomed meaning used by those of reasonable skill in the applicable arts. In the instance where these meanings differ, the words and phrases in the specification and the claims should be given the broadest possible, generic meaning. If it is intended to limit or narrow these meanings, specific, descriptive adjectives will be used. Absent the use of these specific adjectives, the words and phrases in the specification and the claims should be given the broadest possible meaning. If any other special meaning is intended for any word or phrase, the specification will clearly state and define the special meaning.

As used herein, the terms "comprise", "comprises", "comprising", "having", "including", "includes", or any variation thereof, are intended to reference a non-exclusive inclusion, such that a process, method, article, composition or apparatus that comprises a list of elements does not include only those elements recited, but can also include other elements not expressly listed and equivalents inherently known or obvious to those of reasonable skill in the art. Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters or other operating requirements without departing from the scope of the instant invention and are intended to be included in this disclosure.

The use of the words "function", "means" or "step" in the specification or claims is not intended to invoke the provisions of 35 USC 112, Paragraph 6, to define the invention. To the contrary, if such provisions are intended to be invoked to define the invention, then the claims will specifically state the phrases "means for" or "step for" and a function. Contrastingly, the intention is NOT to invoke such provision when then claims cite a "means for" or a "step for" performing a function with recitation of any structure, material, or act in support of the function. If such provision is invoked to define the invention it is intended that the invention not be limited only to the specific structure, materials, or acts that are described in the preferred embodiments, but in addition to include any and all structures, materials, or acts that perform the claimed function, along with any and all known or later-developed equivalent materials, structures, or acts for performing the claimed function.

What is claimed is:

1. A portable archery bow apparatus for transport to any of a plurality of locations to contact the ground at a selected point to provide support and stability while firing an arrow from the bow apparatus, the bow apparatus comprising I. a portable bow unit comprising (a) a central riser having (i) an upper portion, (ii) a lower portion, (iii) a front and a rear, and (iv) a pair of sides;

(b) a hand grip on said central riser, (c) a first upper limb connected to and extending outwardly from said upper portion of said riser;

(d) a second lower limb connected to and extending outwardly from said lower portion of said riser;

(e) rotatable members each mounted on one of said limbs and selected from a group consisting of wheels and cams;

II. only a single portable ground contacting support pole to contact the ground to provide stability while firing an arrow from said bow unit;

III. a first riser boss (53) below said handle grip and intermediate said handle grip and said lower limb, said first riser boss (53)

(i) comprising a side mounting bracket and monopod support element, (ii) fixedly attaching said portable pole directly to one of said sides of said central riser such that said portable pole is positioned laterally and spaced apart from said one of said sides of said central riser, and said bow unit and said pole move simultaneously in unison with said portable pole remaining in fixed orientation with respect to said bow; and, (iii) providing a first stabilizing fixed point of attachment for said pole such that said pole is positioned substantially completely beneath said handle grip and extends downwardly past said second lower limb; and, IV. a second riser boss (54)

(i) fixedly attaching said portable pole directly to said lower portion of said central riser laterally at a point below and spaced apart from said first riser boss to provide a second fixed stabilizing point of attachment for said pole, and one of said sides of said central riser, such that said bow unit and said portable pole move simultaneously in unison, and (ii) providing a second stabilizing fixed point of attachment for said pole such that said pole is positioned substantially beneath said handle grip and extends downwardly past said second lower limb whereby the bow may be moveably positioned and fired without removing the support pole and the riser boss from the bow.

2. A portable archery bow apparatus for transport to any of a plurality of locations to contact the ground at a selected point to provide support and stability while firing an arrow from the bow apparatus, the bow apparatus comprising I. a portable bow unit comprising (a) a central riser having (i) an upper portion, (ii) a lower portion, (iii) a front and a rear, and (iv) a pair of sides;

(b) a hand grip on said central riser, (c) a first upper limb connected to and extending outwardly from said upper portion of said riser;

(d) a second lower limb connected to and extending outwardly from said lower portion of said riser;

(e) rotatable members each mounted on one of said limbs and selected from a group consisting of wheels and cams;

II. only a single portable ground contacting support pole to contact the ground to provide stability while firing an arrow from said bow unit; and, III a first riser boss (53) below said handle grip and intermediate said handle grip and said second lower limb, said first riser boss (53)

(i) comprising a side mounting bracket and monopod support element, (ii) fixedly attaching said portable pole directly to one of said sides of said central riser laterally and spaced apart from said one of said sides of said central riser such that said bow unit and said pole move simultaneously in unison with said portable pole reminain in fixed orientation with respect to said bow; and, (iii) providing a first stabilizing fixed point of attachment for said pole such that said pole is positioned substantially completely beneath said handle grip and extends downwardly past said second lower limb whereby the bow may be moveably positioned and fired without removing the support pole and the riser boss from the bow.

3. The bow apparatus of claim 2 wherein said the length of said pole is adjustable to provide said bow apparatus with an adjustable range of motion.

* * * * *